US008656513B2

(12) United States Patent
Plocher

(10) Patent No.: US 8,656,513 B2
(45) Date of Patent: Feb. 25, 2014

(54) SPORTS GLOVE WITH IMPACT FORCE ATTENUATION SYSTEM

(75) Inventor: Barry Plocher, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 616 days.

(21) Appl. No.: 12/235,005

(22) Filed: Sep. 22, 2008

(65) Prior Publication Data

US 2010/0071108 A1 Mar. 25, 2010

(51) Int. Cl.

| | |
|---|---|
| ***G21F 3/02*** | (2006.01) |
| ***A41D 13/08*** | (2006.01) |
| ***A47J 45/10*** | (2006.01) |

(52) U.S. Cl.

USPC ..... 2/19; 2/16; 2/20; 2/21; 2/161.1; 2/163; 2/161.6; 473/205

(58) Field of Classification Search

USPC ..... 2/455, 16, 17, 18, 19, 20, 21, 158, 159, 2/160, 161.1, 161.2, 161.3, 161.4, 161.6, 2/161.7, 167, 163; D2/610, 611, 612, D2/613, 614, 615, 616, 617, 622, 623; D29/113, 115, 116.1, 116.2, 116.3, D29/117.1, 118, 122, 123; 473/204, 205, 473/206

See application file for complete search history.

(56) References Cited

U.S. PATENT DOCUMENTS

| | | | | | |
|---|---|---|---|---|---|
| 1,465,223 | A | * | 8/1923 | Kobbe | 2/20 |
| 3,890,648 | A | * | 6/1975 | Beal | 2/20 |
| 4,471,538 | A | * | 9/1984 | Pomeranz et al. | 36/28 |
| 4,617,684 | A | * | 10/1986 | Green et al. | 2/20 |
| 4,630,318 | A | * | 12/1986 | Aoki | 2/19 |
| 4,928,320 | A | * | 5/1990 | Aoki | 2/19 |
| 4,987,611 | A | * | 1/1991 | Maye | 2/19 |
| 5,113,530 | A | * | 5/1992 | Smith | 2/19 |
| 5,159,717 | A | * | 11/1992 | Drew et al. | 2/20 |
| 5,173,963 | A | * | 12/1992 | Greenberg | 2/20 |
| 5,218,719 | A | | 6/1993 | Johnson | |
| 5,274,846 | A | * | 1/1994 | Kolsky | 2/460 |
| 5,285,529 | A | * | 2/1994 | Arena | 2/20 |
| 5,297,541 | A | | 3/1994 | Hensey | |
| 5,345,609 | A | * | 9/1994 | Fabry et al. | 2/20 |
| 5,398,342 | A | * | 3/1995 | Kinnee et al. | 2/19 |
| 5,423,088 | A | * | 6/1995 | Walker et al. | 2/19 |
| 5,427,577 | A | | 6/1995 | Picchietti | |
| 6,292,946 | B1 | * | 9/2001 | Angione | 2/20 |
| 6,415,444 | B1 | * | 7/2002 | Kleinert | 2/161.1 |
| 6,453,474 | B2 | * | 9/2002 | Kleinert | 2/161.1 |

(Continued)

FOREIGN PATENT DOCUMENTS

| | | | |
|---|---|---|---|
| JP | 07127679 | A * | 5/1995 |
| WO | WO9119425 | | 12/1991 |
| WO | WO9628056 | | 9/1996 |
| WO | WO2008009945 | | 1/2008 |

OTHER PUBLICATIONS

International Search Report and Written Opinion for PCT/US2009/053824, mailed on Feb. 26, 2010.

*Primary Examiner* — Katherine Moran
*Assistant Examiner* — Katharine Gracz
(74) *Attorney, Agent, or Firm* — Plumsea Law Group, LLC

(57) ABSTRACT

A force attenuation system for a sports glove is disclosed. The force attenuation system includes a pair of foam layers surrounding a fluid-filled chamber. This configuration allows the force attenuation system to reduce forces that a hand experiences when catching a ball with the sports glove.

13 Claims, 6 Drawing Sheets

(56) References Cited

U.S. PATENT DOCUMENTS

| | | | | |
|---|---|---|---|---|
| 6,532,594 | B1 * | 3/2003 | Barnett | 2/20 |
| 6,618,860 | B1 * | 9/2003 | Sullivan et al. | 2/159 |
| 6,634,029 | B1 | 10/2003 | Sullivano | |
| 6,851,123 | B1 * | 2/2005 | Kleinert | 2/19 |
| 6,868,553 | B2 * | 3/2005 | Kleinert | 2/19 |
| 7,025,709 | B2 | 4/2006 | Riggall | |
| 7,150,048 | B2 | 12/2006 | Buckman | |
| 7,353,544 | B1 * | 4/2008 | Kleinert | 2/19 |
| 7,891,017 | B2 * | 2/2011 | Tsukamoto et al. | 2/19 |
| 2002/0108161 | A1 * | 8/2002 | Kleinert | 2/19 |
| 2003/0051285 | A1 | 3/2003 | Bower | |
| 2003/0056273 | A1 * | 3/2003 | Kleinert | 2/19 |
| 2004/0250330 | A1 * | 12/2004 | Berman | 2/20 |
| 2005/0114985 | A1 * | 6/2005 | Falone et al. | 2/161.1 |
| 2006/0064801 | A1 | 3/2006 | Johnson | |
| 2006/0137067 | A1 * | 6/2006 | Wu | 2/19 |
| 2006/0200886 | A1 * | 9/2006 | Tsukamoto et al. | 2/19 |
| 2006/0230636 | A1 * | 10/2006 | Kokstis et al. | 36/35 B |
| 2007/0220650 | A1 * | 9/2007 | Aoki et al. | 2/19 |
| 2008/0060105 | A1 * | 3/2008 | Lin et al. | 2/19 |
| 2009/0113592 | A1 * | 5/2009 | Iwata et al. | 2/19 |
| 2009/0307820 | A1 * | 12/2009 | Yang | 2/19 |

* cited by examiner

SPORTS GLOVE WITH IMPACT FORCE ATTENUATION SYSTEM

BACKGROUND

Sports gloves are used in a variety of athletic activities, whether during competition or training. For example, baseball gloves are utilized in the sport of baseball to assist with catching a baseball and protect a hand from impact with the baseball; softball gloves are utilized in the sport of softball to assist with catching a softball and protect a hand from impact with the softball; hockey gloves are utilized in the sport of hockey to protect hands from sticks, impacts with ice, and when catching a puck; and soccer goalkeeper gloves are utilized in the sport of soccer to protect hands of a goalie from impact with a soccer ball or the feet of other players. Although each of these sports gloves have substantially different structures, these sports gloves serve a common purpose in protecting the hands of athletes.

SUMMARY

A sports glove incorporating a system for attenuating impact forces is disclosed below. Although the configuration of the sports glove may vary significantly, the sports glove may include a pair of foam layers and a fluid-filled chamber located between the foam layers. In some configurations, the fluid-filled chamber is located in a portion of the sports glove corresponding with a metacarpophalangeal joint, and the metacarpophalangeal joint may be associated with an index finger.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose a sports glove 100. Although sports glove 100 is depicted and discussed as having the general form of a baseball glove, further configurations of sports glove 100 may take the form of any sports glove, including softball gloves, hockey gloves, soccer goalkeeper gloves, as well as other kinds of gloves. Sports glove 100 may also have a configurations that is suitable for a particular position within a sport. In baseball, for instance, sports glove 100 may include features specific for a catcher, a first baseman, an infielder, a pitcher, or an outfielder. For example, in configurations where sports glove 100 has a structure suitable for an outfielder, sports glove 100 may be relatively large and include a deep pocket. In the configuration depicted in FIGS. 1 and 2, sports glove 100 is intended to be used with a left hand of the wearer; however, it should be understood that the following discussion may equally apply to a mirror image of sports glove 100 that is intended for use with a right hand of the wearer.

Figure 1:
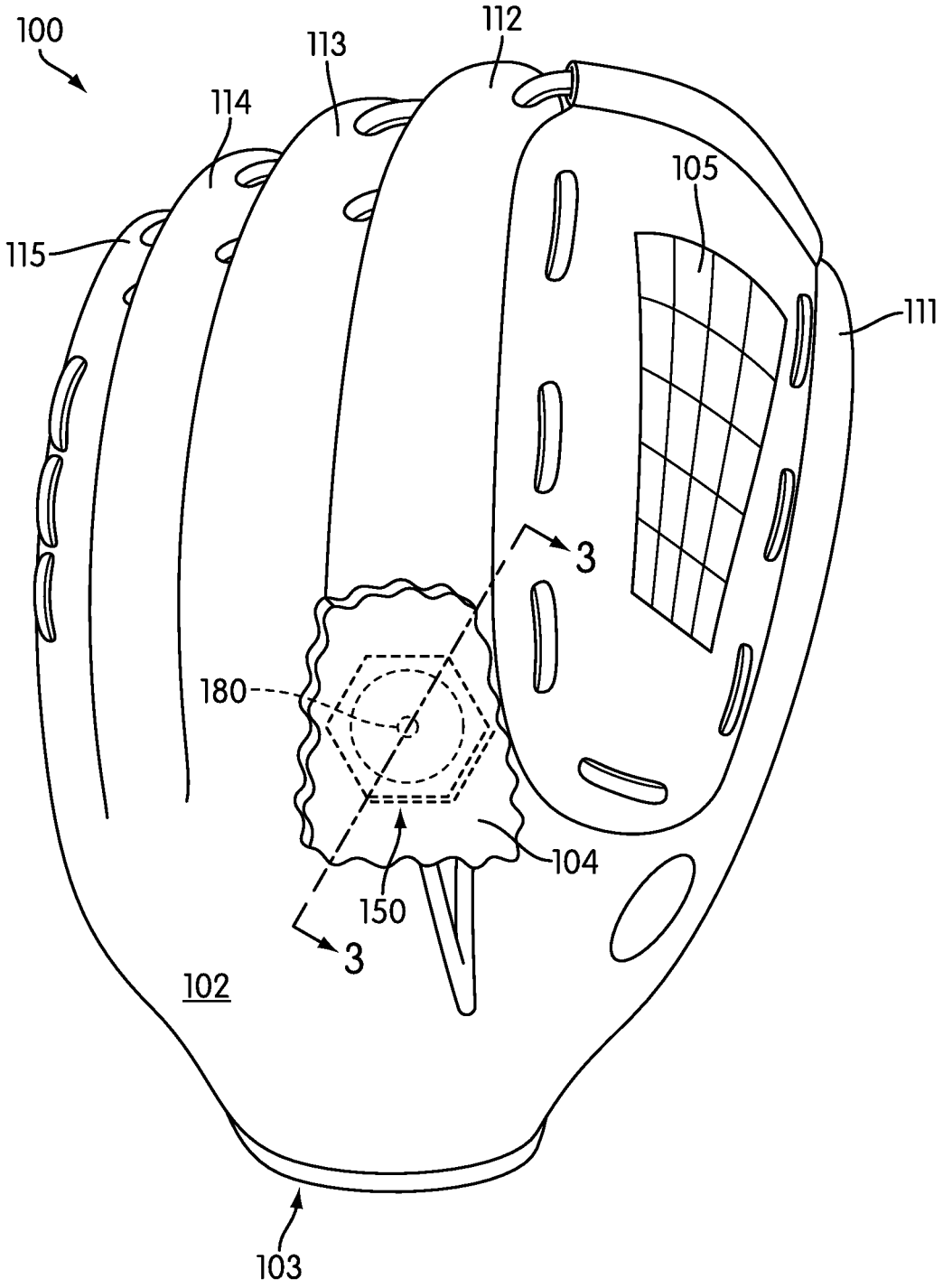
FIG. 1 is a perspective view of a dorsal side of a sports glove.
Figure 2:
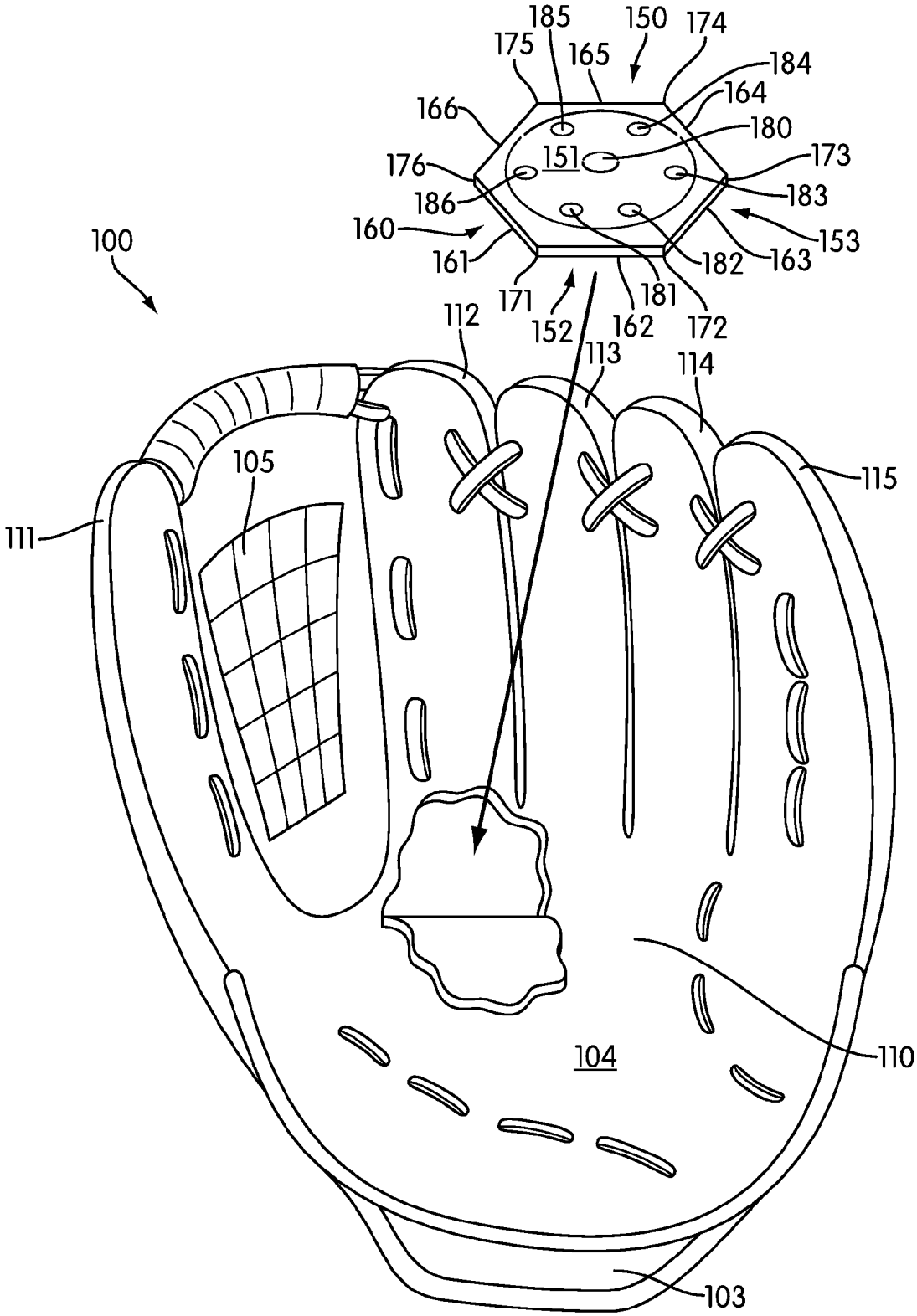
FIG. 2 is a perspective view of a ventral side of the sports glove.

As respectively illustrated in FIGS. 1 and 2, sports glove 100 includes dorsal portion 102 and a ventral portion 104 disposed opposite of dorsal portion 102. Dorsal portion 102 may be associated with a back side of a hand of a wearer of sports glove 100, whereas ventral portion 104 may be associated with a palm side of a hand of a wearer. In some cases, dorsal portion 102 and ventral portion 104 may include an exterior layer disposed on an exterior of sports glove 100 as well as an inner lining disposed adjacent to a back side and palm side, respectively, of a hand of a wearer of sports glove 100.

Typically, dorsal portion 102 and ventral portion 104 may be attached on a periphery of sports glove 100. This can be accomplished by stitching, lacing, or through another manner known in the art. With this arrangement, dorsal portion 102 and ventral portion 104 may define an interior cavity for a hand of a wearer of sports glove 100. Preferably, sports glove 100 is configured to receive a hand of a wearer. In some configurations, sports glove 100 may include hand opening 103 configured to receive a hand of a wearer. With this arrangement, a hand can be inserted into an interior cavity of sports glove 100 through hand opening 103.

Sports glove 100 includes finger portions that can receive fingers of a hand inserted within sports glove 100. More particularly, sports glove 100 includes thumb portion 111, first finger portion 112, second finger portion 113, third finger portion 114 and fourth finger portion 115. Preferably, thumb portion 111, first finger portion 112, second finger portion 113, third finger portion 114 and fourth finger portion 115 may be respectively associated with a thumb, index finger, middle finger, ring finger and little finger of a wearer of sports glove 100.

Glove 100 also includes a webbing 105, which connects thumb portion 111 to first finger portion 112. Generally, webbing 105 may be configured in any manner known in the art. For example, in configurations where sports glove 100 is used for pitching, webbing 105 may have a closed web in order to hide a pitcher's grip on a ball prior to a pitch. In other configurations where a player may want to retrieve a ball quickly after catching the ball, webbing 105 may have an open webbing style.

In addition, sports glove 100 may also include palm portion 110. Palm portion 110 is disposed on ventral portion 104. In some cases, palm portion 110 may cover portions of a palm of hand. In other cases, palm portion 110 may cover an entirety of a palm of a hand. With this arrangement, palm portion 110 can provide some protection for a palm of a hand inserted within sports glove 100.

Typically, sports glove 100 is configured to assist a wearer in catching a ball. In particular, palm portion 110 and surrounding portions may form a pocket for catching a ball. This can allow a wearer to catch a ball within a pocket of sports glove 100. For purposes of clarity, only some portions of sports glove 100 are discussed in this configuration. It should be understood that sports glove 100 may include other provisions that are known in the art for assisting in catching a ball.

When catching a ball within a pocket of sports glove 100, the ball may apply a force to a hand. The force of the impact with a ball can cause pain and discomfort to a wearer of sports glove 100, particularly after repeated impacts. In some cases, some portions of a hand disposed beneath a pocket of sports glove 100 may be particularly vulnerable to the force of an impact with a ball. In particular, a bottom of an index finger may be vulnerable to a force from an impact with a ball. Accordingly, sports glove 100 includes provisions to attenuate the force of an impact with a ball in order to protect a wearer of sports glove 100 from pain or discomfort.

Ventral portion 104 may incorporate materials that attenuate the, forces from an impact with a ball. Generally, ventral portion 104 may include neoprene, slow recovery foams, leather, leather and foam, basic foam as well as other materials to provide protection during catching. In some cases, these materials may be used to form one or more pads that protect a hand during catching. For example, in one configuration, ventral portion 104 may include a heel pad adjacent to hand opening 103 to absorb an impact with a caught ball.

In configurations where a pre-designated portion of a hand may be exposed to impacts with a ball or other object, sports glove 100 may include additional provisions to help protect the pre-designated portion of the hand. In some cases, additional padding or foam can be associated with the pre-designated portion. In other cases, a fluid-filled chamber can be associated with the pre-designated portion to help attenuate forces. Additionally, a fluid-filled chamber can be used in cooperation with one or more padding layers.

As illustrated in a cut away view of dorsal portion 102 and a portion of ventral portion 104 in FIG. 1, ventral portion 104 includes fluid-filled chamber 150 to protect a hand from a force of an impact with a ball. A fluid enclosed by fluid-filled chamber 150 may be a gas or a liquid. Examples of fluid-filled chambers may be found in U.S. Patent Publication Number 2006/0230636, to Kokstis et al., the entirety of which is incorporated here by reference. By placing fluid-filled chamber 150 within ventral portion 104, fluid-filled chamber 150 may attenuate some of the force of an impact with a ball. In particular, fluid-filled chamber 150 can be disposed at a bottom portion of first finger portion 112 adjacent to palm portion 110 within ventral portion 104, as illustrated in an exploded view in FIG. 2. With this preferred arrangement, fluid-filled chamber 150 can protect a bottom portion of an index finger, including a joint associated with the index finger, from the force of an impact with a ball caught with sports glove 100.

Although only one fluid-filled chamber 150 is included in ventral portion 104 to protect a bottom portion of an index finger, more than one fluid-filled chamber 150 may be included to protect a hand from an impact in other configurations. In some cases, two fluid-filled chambers may cooperate to protect a portion of a hand from an impact with a ball. In other cases, more than two fluid-filled chambers may be configured to protect a portion of a hand from a force of an impact with a ball.

Generally, fluid-filled chamber 150 may be formed by any manner known in the art. As illustrated in an exploded view in FIG. 2, fluid-filled chamber 150 includes first surface 151 and second surface 152 disposed opposite of first surface 151. First surface 151 and second surface 152 may be sealed at their respective peripheries to form peripheral bond 153. With this arrangement, first surface 151 and second surface 152 may cooperatively form a sealed structure for enclosing a pressurized fluid.

Peripheral bond 153 forms edge set 160, which includes first edge 161, second edge 162, third edge 163, fourth edge 164, fifth edge 165 and sixth edge 166. First edge 161 is connected to second edge 162 at first vertex 171. Similarly, second edge 162 is connected to third edge 163 at second vertex 172. Likewise, third edge 163 is connected to fourth edge 164 at third vertex 173. Fourth edge 164 is joined to fifth edge 165 at fourth vertex 174. In a similar manner, fifth edge 165 is joined to sixth edge 166 at fifth vertex 175. Finally, sixth edge 166 is connected to first edge 161 at sixth vertex 176. With this arrangement, edges of edge set 160 encircle fluid-filled chamber 150. Generally, edges 161-166 of edge set 160 can have various configurations. In some cases, edges of edge set 160 may be convex. In other cases, edges of edge set 160 may be concave. In still other cases, edges of edge 160 may be a mixture of concave and convex edges. Edges of edge set 160 may also be straight.

Fluid-filled chamber 150 is incorporated into sports glove 100 to reduce the force of an impact from a ball. Generally, any type of fluid can be used with fluid-filled chamber 150. In some configurations, fluid-filled chamber 150 may enclose a liquid to attenuate the forces of an impact with a ball. In other configurations, fluid-filled chamber 150 can enclose a gas (e.g., air, nitrogen) to attenuate the forces of an impact with a ball. In still other configurations, fluid-filled chamber 150 may enclose a gel to attenuate the forces of an impact with a ball.

Fluid-filled chamber 150 may be filled with a liquid, gas or gel to obtain various pressures above ambient pressure. This can be achieved by inserting a nozzle or needle connected to a pressure source into an inlet in fluid-filled chamber 150. For purposes of clarity, the inlet is not shown in this configuration. Fluid-filled chamber 150 may be filled to a pressure in the range of one to thirty-five pounds per square inch. In some cases, fluid-filled chamber 150 may be filled to a pressure of approximately twenty pounds per square inch. By filling fluid-filled chamber 150 to different pressures, the force attenuating features of fluid-filled chamber 150 may be tuned or otherwise adjusted to the preferences of the wearer.

A pressurized fluid-filled chamber can include provisions to strengthen the bond between first surface 151 and second surface 152. For example, fluid-filled chamber 150 may include internal connections between first surface 151 and second surface 152. In other words, first surface 151 can be connected to second surface 152 at portions other than peripheral bond 153. Generally, internal connections can be disposed in any arrangement to create a desired configuration for fluid-filled chamber 150. In this configuration, first surface 151 and second surface 152 may be connected at portions adjacent to peripheral bond 153 to increase the structural integrity of fluid-filled chamber 150. In particular, first surface 151 and second surface 152 are connected at first connection 181, second connection 182, third connection 183, fourth connection 184, fifth connection 185 and sixth connection 186. First connection 181 is disposed adjacent to first vertex 171. Likewise, second connection 182 is disposed adjacent to second vertex 172. Similarly, third connection 183 is adjacent to third vertex 173. Fourth connection 184 is disposed adjacent to fourth vertex 174. In a similar manner, fifth connection 185 is adjacent to fifth vertex 175. Also, sixth connection 186 is disposed adjacent to sixth vertex 176. In some cases, first surface 151 and second surface 152 may also be connected at central connection 180, which may be spaced inward from peripheral bond 153 and positioned substantially in the center of fluid-filled chamber 150, as depicted in FIGS. 1-4. With this arrangement, the connection between first surface 151 and second surface 152 may be reinforced.

Generally, fluid-filled chamber 150 may comprise any material known in the art including, but not limited to polyurethane, polyester, polyester polyurethane and polyether polyurethane. In some cases, first surface 151 and second surface 152 may each include alternating layers of thermoplastic polyurethane and ethylene-vinyl alcohol copolymer, as disclosed in U.S. Pat. Nos. 5,713,141 and 5,952,065, the entirety of which are incorporated by reference. In other configurations, first surface 151 and second surface 152 can be made of other materials. Other materials disclosed in U.S. Patent Publication Number 2006/0230636 may also be utilized for fluid-filled chamber 150.

Furthermore, fluid-filled chamber 150 may be manufactured with any method known in the art. In some cases, fluid-filled chamber 150 may be manufactured by placing two thermoplastic polymer sheets in a mold as discussed in U.S. Patent Publication Number 2006/0230636. In other cases, other manufacturing methods known in the art may be used, including twin sheet molding and blow molding.

In sports glove 100, fluid-filled chamber 150 may be used in conjunction with other provisions to further attenuate the force of an impact with a ball and protect a hand. In some configurations, a pad may be disposed adjacent to fluid-filled chamber 150 to provide further protection from an impact with a ball. In other configurations, a single foam layer may be used with fluid-filled chamber 150 to further reduce the force transferred to a hand from an impact with a ball. In another configuration, a cushioning system can include a pair of foam layers surrounding fluid-filled chamber 150 in order to attenuate the force of an impact. By using a fluid-filled chamber surrounded by a pair of foam layers, the force from an impact with a ball may be substantially reduced.

Figure 3:
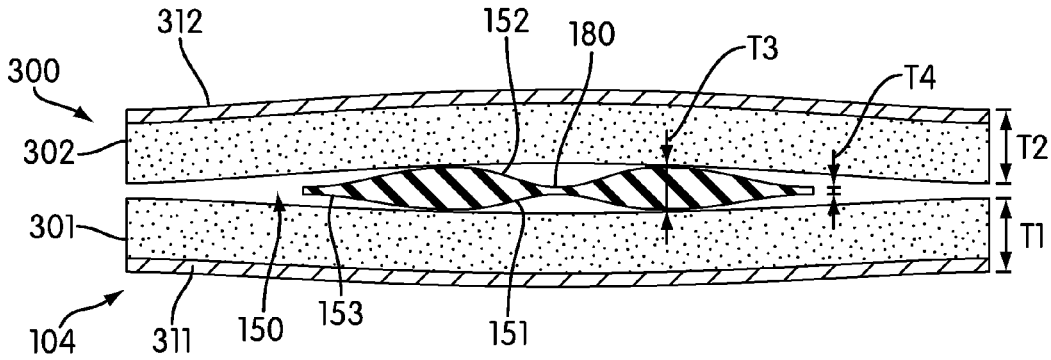
FIG. 3 is a cross-sectional view of the sports glove, as defined by section line 3-3 in FIG. 1.
Figure 4:
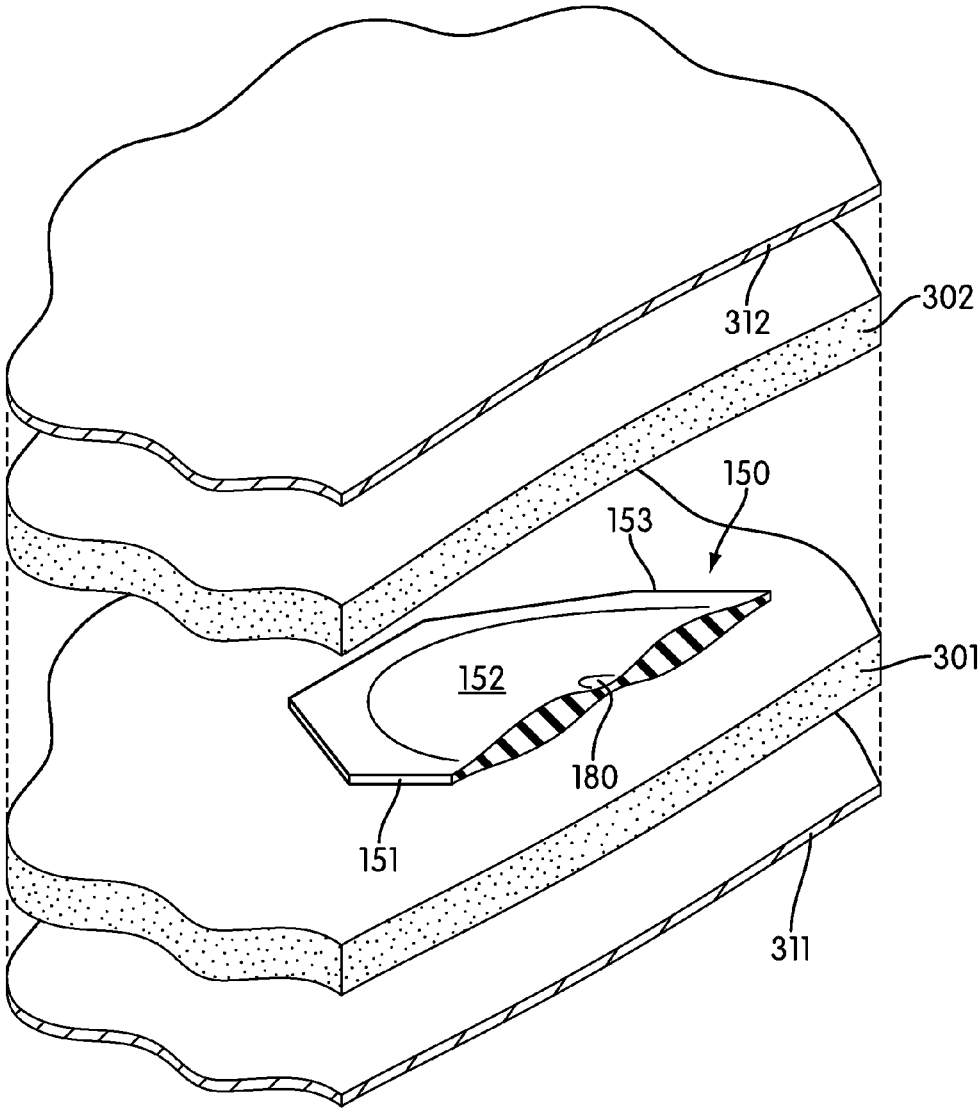
FIG. 4 is an exploded perspective view of a cushioning system of the sports glove.

Referring to FIGS. 3 and 4, a cushioning system 300 is disposed within ventral portion 104 proximate to first finger portion 112 as previously discussed with respect to FIGS. 1 and 2. However, in other configurations, cushioning system 300 may be disposed in another portion of ventral portion 104 to protect another portion of a hand. In some cases, cushioning system 300 may be disposed between exterior layer 311 and inner lining 312 of ventral portion 104. Exterior layer 311 may be associated with an exterior of sports glove 100, as illustrated in FIG. 2. Similarly, inner lining 312 may be disposed adjacent to a hand inserted within sports glove 100. In other configurations, cushioning system 300 may be disposed within additional layers or linings of ventral portion 104.

Cushioning system 300 includes a first foam layer 301 and a second foam layer 302 disposed on either side of fluid-filled chamber 150. In particular, first foam layer 301 is disposed between exterior layer 311 and first surface 151 of fluid-filled chamber 150. Similarly, second foam layer 302 is disposed between second surface 152 of fluid-filled chamber 150 and inner lining 312. With this arrangement, cushioning system 300 may protect a hand disposed adjacent to inner lining 312 of ventral portion 104 from an impact with a ball caught against exterior layer 311.

Generally, first foam layer 301 and second foam layer 302 can comprise any material that can dampen a force of an impact with a ball including, but not limited to slow recovery foams, basic foams, urethane foams, as well as other materials. In some configurations, first foam layer 301 and second foam layer 302 may comprise the same material. In other configurations, first foam layer 301 and second foam layer 302 can comprise different materials. In further configurations, first foam layer 301 and second foam layer 302 both comprise urethane foam. The thicknesses of one or more foam layers may also vary. In some configurations, first foam layer 301 and second foam layer 302 may exhibit substantially similar thicknesses. In other configurations, first foam layer 301 and second foam layer 302 may exhibit different thicknesses. In the configuration depicted in FIG. 3, first foam layer 301 is configured with thickness T1. Likewise, second foam layer 302 is configured with thickness T2. Preferably, thickness T2 is substantially similar to thickness T1, but may vary significantly. By modifying the thicknesses of first foam layer 301 and second foam layer 302, the cushioning properties of cushioning system 300 can be modified.

The thickness of fluid-filled chamber 150 may also vary. As depicted in FIG. 3, fluid-filled chamber 150 has a maximum thickness T3 and a minimum thickness T4 that is associated with central connection 180. Maximum thickness T3 may be less than first thickness T1 of first foam layer 301 and thickness T2 of second foam layer 302. With this arrangement, the local curvature of fluid-filled chamber 150 may be smoothed out by first foam layer 301 and second foam layer 302. In other configurations, however, fluid-filled chamber 150 could have a maximum thickness that is greater than the thicknesses of adjacent foam layers.

Generally, foam layers 301 and 302 can be configured in any shape. Examples of different shapes include, but are not limited to square shapes, rectangular shapes, round shapes, elliptical shapes, triangular shapes, regular shapes, irregular shapes as well as other types of shapes. In some cases, each of foam layers 301 and 302 may be configured with different shapes and sizes. As an example, first foam layer 301 may cover a greater area of a hand than second foam layer 302. In other cases, each of foam layers 301 and 302 may be configured with substantially similar shapes and sizes.

Cushioning system 300 is configured with first foam layer 301 and second foam layer 302 extending beyond peripheral bond 153 of fluid-filled chamber 150. This arrangement allows first foam layer 301 and second foam layer 302 to cover all portions of fluid-filled chamber 150. Furthermore, first foam layer 301 and second foam layer 302 can attenuate a force of an impact on areas surrounding fluid-filled chamber 150 by extending beyond peripheral bond 153. In some cases, for example, first foam layer 301 and second foam layer 302 can extend over an entire palm portion of a sports glove. In other configurations, however, cushioning system 300 can be configured so that first foam layer 301 and/or second foam layer 302 do not extend beyond peripheral bond 153. In some cases, first foam layer 301 and/or second foam layer 302 may not cover an entirety of fluid-filled chamber 150. By manipulating the arrangement of first foam layer 301, fluid-filled chamber 150 and second foam layer 302, the force attenuating properties of cushioning system 300 can be tuned or otherwise adjusted for different areas of sports glove 100.

Cushioning system 300 provides increased force attenuating properties over previous designs. In particular, by using fluid-filled chamber 150 in combination with foam layers 301 and 302, cushioning system 300 can reduce the amount of force transferred directly to a hand from an impact with a ball during a catch. Furthermore, in other configurations, cushioning system 300 can attenuate forces applied by any other type of object. In other words, the effects of cushioning system 300 are not limited to attenuating forces applied to a glove by balls. For example, in configurations where concepts related to sports glove 100 are incorporated into a hockey glove, cushioning system 300 can help attenuate forces applied by a puck.

Figure 5:
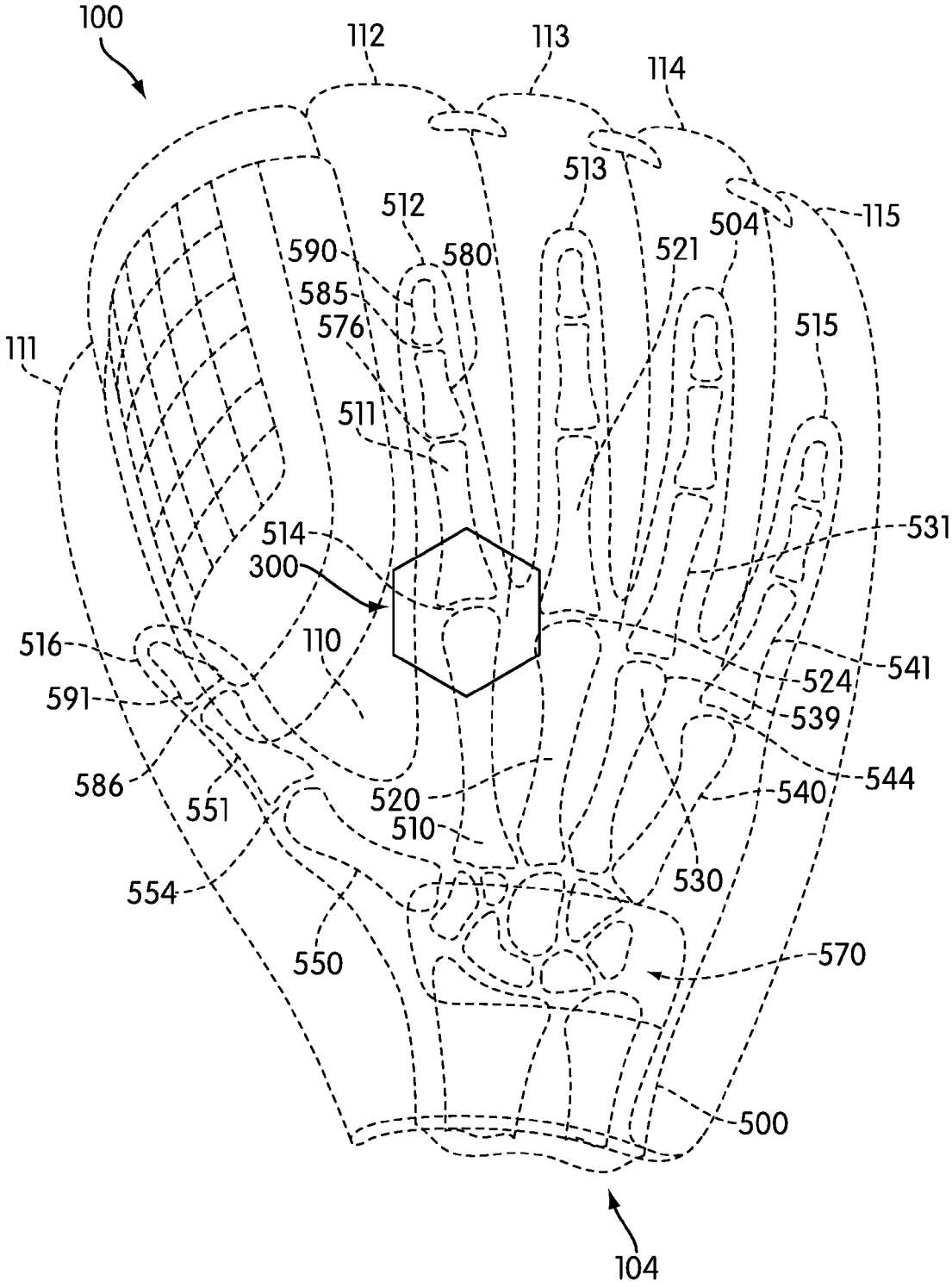
FIG. 5 is a schematic perspective view of a hand inserted within the sports glove.

FIG. 5 illustrates a schematic view of a hand 500 inserted within sports glove 100. The fit of hand 500 within sports glove 100 is intended to be exemplary. In other configurations, hand 500 may fit within sports glove 100 in a different manner. For example, in some cases, the fingers of hand 500 may be longer and extend further within finger portions of sports glove 100. For illustrative purposes, the bones of hand 500 are visible. In addition, sports glove 100 and hand 500 are illustrated in phantom in this configuration. This allows the arrangement of cushioning system 300 above the bones of hand 500 to be visible.

As previously discussed, cushioning system 300 is disposed adjacent to palm portion 110 and first finger portion 112 of ventral portion 104. This allows cushioning system 300 to protect a vulnerable portion of an index finger that may receive an impact from a ball caught within a pocket of sports glove 100. In particular, cushioning system 300 may be disposed to protect metacarpophalangeal joint 514 of index finger 512. metacarpophalangeal joint 514 connects metacarpal 510 with proximal phalanx 511. By covering metacarpophalangeal joint 514 and surrounding areas, cushioning system 300 may protect a vulnerable area where a ball is often caught.

In some cases, metacarpophalangeal joints of the remaining fingers of hand 500 may also be vulnerable to a force from an impact with a ball. Middle finger 513 includes metacarpophalangeal joint 524 that connects metacarpal 520 with proximal phalanx 521. Similarly, ring finger 504 includes metacarpophalangeal joint 539 that connects metacarpal 530 with proximal phalanx 531. Also, little finger 515 includes metacarpophalangeal joint 544 that connects metacarpal 540 with proximal phalanx 541. Finally, thumb 516 includes metacarpophalangeal joint 554 that connects metacarpal 550 with proximal phalanx 551. It is possible that any or all of these metacarpophalangeal joints can be vulnerable to an impact with a ball due to their close proximity to a pocket of sports glove 100.

In addition, the remaining bones and joints of fingers of hand 500 may also receive an impact from a ball. For example, each finger includes distal phalanges 590. Except for thumb 516, distal phalanges 590 are connected to middle phalanges 580 by distal interphalangeal joints 585, also referred to as DIP joints 585. On thumb 516, distal phalanx 591 is connected via interphalangeal joint 586, hereby referred to as IP joint 586, to proximal phalanx 551. In the other fingers, interphalangeal joints 576, here by referred to as IP joints 576, connect proximal phalanges with middle phalanges 580. Any of the joints and associated phalanges of the fingers of hand 500 can receive a force from an impact with a ball.

Furthermore, other bones and joints associated with hand 500 may also receive a force from an impact with a ball. For example, a palm of hand 500 includes carpus 570. Carpus 570 includes eight carpal bones but only seven carpal bones are visible in this illustration. A portion of carpus 570 and related joints are disposed directly beneath a pocket of sports glove 100. In some cases, carpus 570 can receive an impact from a ball.

Generally, fluid-filled chamber 150 of cushioning system 300 can be configured in any shape to protect any portion of a hand. Examples of different shapes include, but are not limited to square shapes, rectangular shapes, elliptical shapes, triangular shapes, regular shapes, irregular shapes as well as other types of shapes. In some cases, fluid-filled chamber 150 may be configured in a particular shape in order to provide protection for a portion of a hand. In other cases, fluid-filled chamber 150 can be configured in a particular shape for ease of manufacturing a plurality of fluid-filled chambers in that shape. In still other cases, fluid-filled chamber 150 can be configured in a particular shape that aligns with a portion of a glove and does not interfere with the flexibility of a sports glove to form a pocket to catch a ball.

Figure 6:
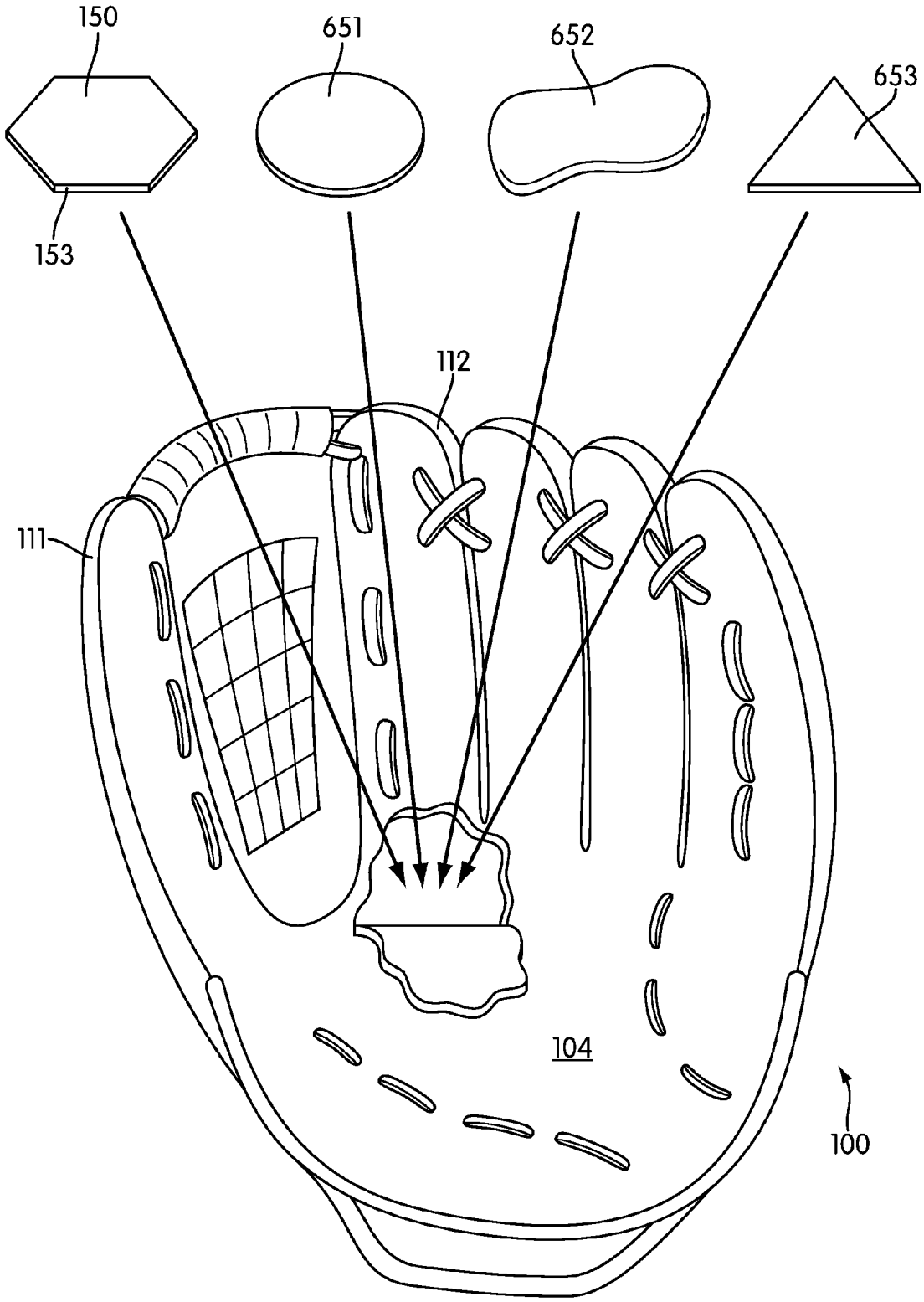
FIG. 6 is a schematic perspective view of alternate configurations of a fluid-filled chamber for the cushioning system of the sports glove.

FIG. 6 illustrates an exemplary configuration of some possible shapes for a fluid-filled chamber embedded in sports glove 100. These shapes are not intended to be limiting. For purposes of clarity, foam layers 301 and 302 are not illustrated in this diagram. However, it should be understood that foam layers 301 and 302 can surround any of the possible shapes of a fluid-filled chamber to form a cushioning system. As previously discussed with reference to FIGS. 1 and 2, sports glove 100 can include fluid-filled chamber 150. Fluid-filled chamber 150 comprises a generally hexagonal shape with six edges disposed on peripheral bond 153. However, in other configurations, sports glove 100 can include circular fluid-filled chamber 651, or triangular fluid-filled chamber 653, for example. Circular fluid-filled chamber 651 may be configured with a generally circular shape. With a generally circular shape that lacks edges, circular fluid-filled chamber 651 may enhance the flexibility of sports glove 100 in forming a pocket to catch a ball. Sports glove 100 may also be associated with an asymmetric irregularly shaped fluid-filled chamber. For example, sports glove 100 can include asymmetric fluid-filled chamber 652. By having an irregular shape, asymmetric fluid-filled chamber 652 can be configured to fit within sports glove 100 and cover desired portions of hand. In some cases, asymmetric fluid-filled chamber 652 can be configured to extend further into first finger portion 112 to cover more portions of an index finger. In other cases, asymmetric fluid-filled chamber 652 can be configured to extend into a portion of thumb portion 111 to cover a metacarpophalangeal joint of a thumb, as illustrated in FIG. 5.

A cushioning system can be configured with different sizes to protect various portions of a hand from a force of an impact with a ball. FIGS. 7-10 illustrate schematic views of exemplary configurations of a cushioning system disposed within a ventral portion of a sports glove. These configurations are intended to be exemplary and not limiting. In other configurations, a cushioning system can be configured to cover other portions of a hand. Furthermore, the cushioning systems illustrated in FIGS. 7-10 may be configured in a substantially similar manner as cushioning system 300 illustrated in FIGS. 3 and 4. In particular, the cushioning systems in these exemplary configurations can include a pair of foam layers surrounding a fluid-filled chamber.

Figure 7:
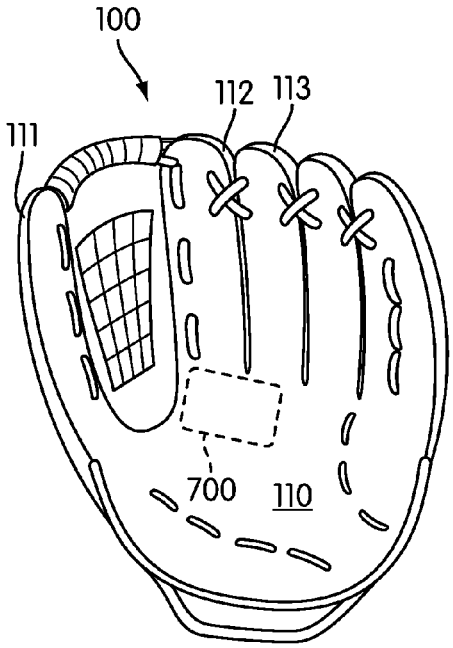
FIGS. 7-10 are perspective views of further configurations of the cushioning system for the sports glove.

In some cases, a cushioning system may be configured to protect metacarpophalangeal joints of an index finger and a middle finger. Referring to FIG. 7, cushioning system 700 is disposed adjacent to first finger portion 112 and second finger portion 113 within palm portion 110 of sports glove 100. Preferably, this configuration allows cushioning system 700 to protect metacarpophalangeal joints of an index finger and a middle finger. Furthermore, in this position, cushioning system 700 also provides protection to portions of adjacent bones of metacarpophalangeal joints of the index finger and middle finger. With this arrangement, cushioning system 700 can absorb energy from an impact with a ball and protect portions of an index finger and a middle finger.

Figure 8:
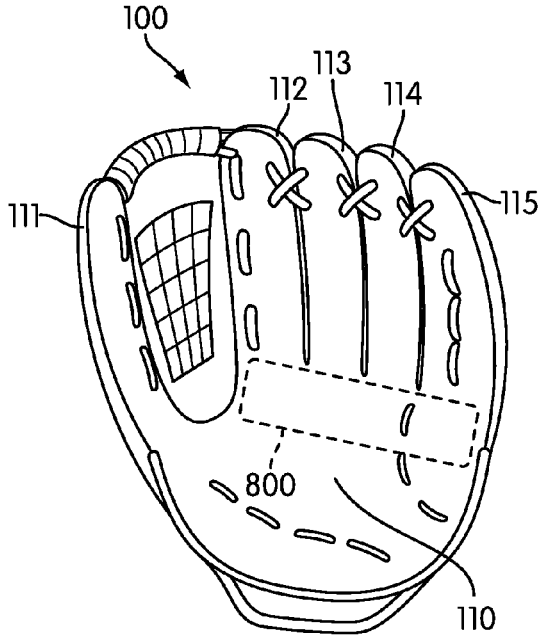

In some configurations, a cushioning system may be configured to protect metacarpophalangeal joints of four fingers of a hand. Referring to FIG. 8, cushioning system 800 is disposed adjacent to first finger portion 112, second finger portion 113, third finger portion 114 and fourth finger portion 115 within palm portion 110 of sports glove 100. With this arrangement, cushioning system 800 can protect metacarpophalangeal joints of an index finger, middle finger, ring finger and little finger. In addition, cushioning system 800 can provide protection to surrounding bones of the metacarpophalangeal joints. This allows cushioning system 800 to attenuate a force of an impact and protect portions of four fingers of hand from an impact with a ball.

Figure 9:
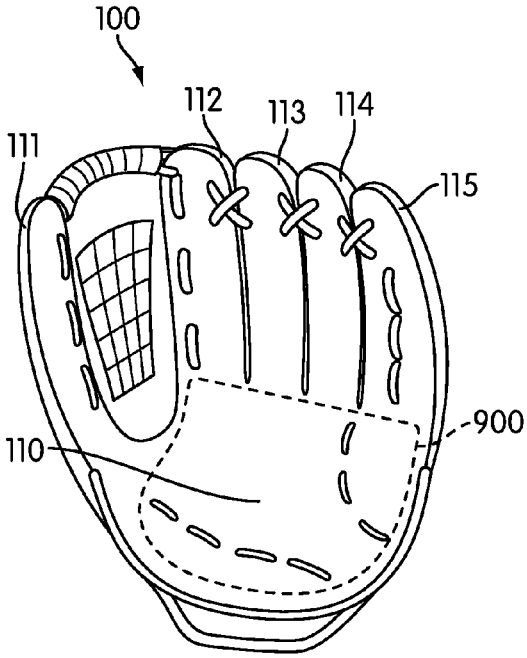

A cushioning system may also protect a palm portion of a hand from an impact with a ball. Referring to FIG. 9, cushioning system 900 covers a majority of palm portion 110 of sports glove 100. This configuration allows cushioning system 900 to cover carpal bones of a hand as well as metacarpophalangeal joints of an index finger, ring finger, middle finger and little finger. With this arrangement, cushioning system 900 will attenuate a force of an impact of a ball striking palm portion 110 to protect a palm and portions of four fingers of a hand.

Figure 10:
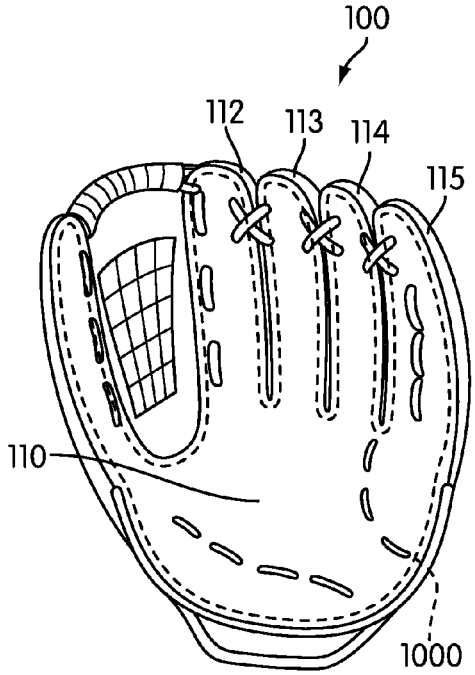

It is also possible that a cushioning system can protect an entire palm side of a hand. Referring to FIG. 10, cushioning system 1000 covers a substantial entirety of ventral portion 104 of sports glove 100. In other words, cushioning system 1000 covers palm portion 110, thumb portion 111, first finger portion 112, second finger portion 113, third finger portion 114 and fourth finger portion 115. With this arrangement, cushioning system 1000 protects a substantial entirety of ventral portion 104 from a force of an impact with a ball.

Generally, a cushioning system can include any number of fluid-filled chambers surrounded by a pair of foam layers to protect a hand within a sports glove. By combining a plurality of fluid-filled chambers configured with various sizes and shapes, a cushioning system can provide protection to any portion of a hand. In some configurations, a plurality of fluid-filled chambers of substantially similar size and shape can be disposed adjacent to each other between a pair of foam layers to protect a portion of a hand. For example, cushioning system 800 illustrated in FIG. 8 can include two substantially identical rectangular shaped fluid-filled chambers that are a similar size to a fluid-filled chamber used in cushioning system 700 illustrated in FIG. 7. By placing the two rectangular shaped fluid-filled chambers adjacent to each other, cushioning system 800 can cover metacarpophalangeal joints of an index finger, middle finger, ring finger and little finger as illustrated in FIG. 8. Furthermore, in other configurations, a plurality of fluid-filled chambers of complementary shapes can be applied in a tessellation pattern in order to cover a portion of a sports glove within minimal gaps or overlap between adjacent fluid-filled chambers.

In other configurations, fluid-filled chambers of different sizes and/or shapes can be combined between a pair of foam layers to create a cushioning system that extends over a portion of a hand. For instance, cushioning system 900 illustrated in FIG. 9 can include a rectangular shaped fluid-filled chamber surrounded by four half-circle shaped fluid-filled chambers in order to protect four metacarpophalangeal joints of four fingers and a palm portion of a hand. In another example, cushioning system 1000 illustrated in FIG. 10 can include an irregularly shaped fluid-filled chamber that covers palm portion 110 as well as finger shaped fluid-filled chambers disposed in each finger portion of sports glove 100. Using this arrangement, a cushioning system can be configured to extend over different portions of a sports glove to provide protection to multiple portions of a hand.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sports glove, comprising:

an exterior layer disposed on a ventral side of the sports glove;

a first foam layer disposed adjacent to the exterior layer;

an inner lining configured to contact a hand of a wearer;

a second foam layer disposed adjacent to the inner lining; and a fluid-filled chamber disposed between the first foam layer and the second foam layer and disposed at a bottom of a finger portion of the sports glove associated with a finger of the hand of the wearer, the chamber having a first surface and an opposite second surface, the first surface and second surface being sealed at a peripheral bond, wherein the first foam layer has a first thickness, the second foam layer has a second thickness, the fluid-filled chamber has a third thickness, and the third thickness is less than the first thickness and the second thickness, and wherein both the first foam layer and the second foam layer extend beyond the peripheral bond to surround and cover all portions of the fluid-filled chamber.

2. The sports glove according to claim 1, wherein the fluid-filled chamber is disposed at a bottom of a first finger portion of the sports glove associated with an index finger of the hand of the wearer.

3. A sports glove, comprising:

a pre-designated portion disposed at a bottom of a finger portion of the sports glove associated with a finger of a hand of a wearer; and a pressurized gas-filled chamber configured to provide cushioning, the chamber having a first surface and an opposite second surface, the first surface and the second surface (a) being sealed at a peripheral bond, and (b) having an internal connection spaced inward from the peripheral bond, and the pressurized gas-filled chamber being located between a first foam layer and a second foam layer, the first foam layer and the second foam layer surrounding the pressurized gas-filled chamber, extending beyond the peripheral bond, and covering all portions of the pressurized gas-filled chamber;

wherein the sports glove further comprises an exterior layer disposed on a ventral side of the sports glove and an inner lining configured to contact the hand, and wherein the pressurized gas-filled chamber is disposed in the pre-designated portion and between the exterior layer and the inner lining.

4. The sports glove according to claim 3, wherein the pressurized gas-filled chamber has a regular shape.

5. The sports glove according to claim 3, wherein the pre-designated portion is disposed at a bottom of a first finger portion of the sports glove associated with an index finger of the hand of the wearer.

6. The sports glove according to claim 1, wherein the first surface and the second surface include alternating layers of a first polymer material and a second polymer material.

7. The sports glove according to claim 3, wherein the first surface and the second surface include alternating layers of a first polymer material and a second polymer material.

8. A sports glove having a dorsal portion corresponding with a back side of a hand of a wearer, a ventral portion disposed opposite the dorsal portion and corresponding with a palm side of the hand of the wearer, and a webbing, the dorsal portion and the ventral portion being attached on a periphery of the sports glove and defining an interior cavity for the hand, and the ventral portion comprising:

an exterior layer disposed on an exterior of the sports glove;

an inner lining configured to contact the hand; and a cushioning system disposed between the exterior layer and the inner lining, the cushioning system including (a) a pressurized fluid-filled chamber having a first surface, an opposite second surface, a peripheral bond, and an internal connection spaced inward from the peripheral bond on all sides, (b) a first foam layer disposed between the exterior layer and the first surface of the pressurized fluid-filled chamber, and (c) a second foam layer disposed between the second surface of the pressurized fluid-filled chamber and the inner lining, wherein the pressurized fluid-filled chamber is disposed at a bottom of a finger portion of the sports glove associated with a finger of the hand of the wearer, and wherein the first foam layer and the second foam layer extend beyond the peripheral bond of the pressurized fluid-filled chamber and cover all portions of the pressurized fluid-filled chamber.

9. The sports glove according to claim 8, wherein the pressurized fluid-filled chamber is disposed at a bottom of a first finger portion of the sports glove associated with an index finger of the hand of the wearer.

10. The sports glove according to claim 8, wherein the first foam layer has a first thickness, the second foam layer has a second thickness, the pressurized fluid-filled chamber has a third thickness, and the third thickness is less than the first thickness and the second thickness.

11. The sports glove according to claim 8, wherein the pressurized fluid-filled chamber is a pressurized gas-filled chamber.

12. The sports glove according to claim 8, wherein the internal connection is formed in a central portion of the pressurized fluid-filled chamber.

13. The sports glove according to claim 12, wherein the internal connection is a central connection positioned substantially in a center of the pressurized fluid-filled chamber.

* * * * *